US007495677B2

(12) United States Patent
Furihata et al.

(10) Patent No.: US 7,495,677 B2
(45) Date of Patent: Feb. 24, 2009

(54) CONTROLLER DRIVER AND DISPLAY PANEL DRIVING METHOD

(75) Inventors: Hirobumi Furihata, Kanagawa (JP); Junyou Shioda, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 770 days.

(21) Appl. No.: 11/049,750

(22) Filed: Feb. 4, 2005

(65) Prior Publication Data

US 2005/0174314 A1 Aug. 11, 2005

(30) Foreign Application Priority Data

Feb. 6, 2004 (JP) ..... 2004-031233

(51) Int. Cl.
*G09G 5/00* (2006.01)

(52) U.S. Cl. ..... 345/636; 345/629

(58) Field of Classification Search ..... 345/636, 345/629

See application file for complete search history.

(56) References Cited

U.S. PATENT DOCUMENTS 5,195,180 A * 3/1993 Takakura et al. ..... 715/729
5,467,109 A * 11/1995 Nagaoka ..... 345/589
5,640,172 A * 6/1997 Kim ..... 345/26
5,721,568 A * 2/1998 Kim ..... 345/467
6,181,353 B1 * 1/2001 Kurisu ..... 345/537
6,195,078 B1 * 2/2001 Dinwiddie et al. ..... 345/636
6,483,510 B1 * 11/2002 Jeong ..... 345/467
6,704,027 B2 * 3/2004 Nakano ..... 345/636
7,164,431 B1 * 1/2007 Chu et al. ..... 345/636
7,170,564 B2 * 1/2007 Maruoka et al. ..... 348/564
7,251,365 B2 * 7/2007 Fux et al. ..... 382/185

FOREIGN PATENT DOCUMENTS

JP 2002-182627 6/2002
JP 2003-216135 7/2003

OTHER PUBLICATIONS

Chinese Office Action dated May 18, 2007 with English translation.

* cited by examiner

*Primary Examiner*—M Good Johnson
(74) *Attorney, Agent, or Firm*—McGinn IP Law Group, PLLC

(57) ABSTRACT

A controller driver includes a driving process circuit configured to receive background bit map data of a background image and font data for a character image, and a font drawing circuit configured to generate pixel data of the character image from the font data. The font data for a pixel is described in a format in which a bit length of the font data for the pixel shorter than in a RGB format, and the driving processing circuit displays on a display panel a synthetic image in which the character image is superimposed on the background image in an on-screen display mode, by driving the display panel based on the background bit map data and the pixel data of the character image.

33 Claims, 14 Drawing Sheets

Fig. 11

6

| COLOR REFERENCE NO. | COLOR |
|---|---|
| 0 | TRANSPARENT |
| 1 | BLUE |
| 2 | RED |
| 3 | YELLOW |

CONTROLLER DRIVER AND DISPLAY PANEL DRIVING METHOD

BACKGROUND OF THE INVENTION

1. Field of the Invention

The present invention generally relates to a controller driver and a display panel driving method. More specifically, the present invention is directed to a technique of reducing power consumption of a controller driver used to drive a display panel.

2. Description of the Related Art

In general, a display panel such as a liquid crystal display (LCD) panel is driven by a controller driver. The controller driver is sometimes provided separately from the display panel, and the controller driver is sometimes provided with the display panel by using the COG (chip on glass) technique. The controller driver receives display data to be displayed, and stores the received display data in a display memory. Based on the display data stored in the display memory, the controller driver drives data lines of the display panel.

In the controller driver mounted on a mobile terminal such as a portable telephone and a PDA (personal data assistants), the reduction of power consumption is important. If the power consumption of the mobile terminal is reduced, the operation time during which the mobile terminal can be operated through a single recharging operation can be prolonged. The prolongation of such an operation time is effective to use the mobile terminal in more convenient manner.

Japanese Laid Open Patent Application (JP-P2002-182627A) discloses a technique of reducing the power consumption of a controller driver. The controller driver in this conventional example is provided with a latch circuit for receiving display data, and a display memory which does not contain a sense amplifier. A plurality of bits of the display data are latched by the latch circuit. The bit lines of the display memory are directly driven by the latch circuit. Since the sense amplifier is not used, the power consumption of this controller driver is low. Further, since the plurality of data bits are written in the display memory by the latch circuit, a total number of times when word lines of the display memory are activated is decreased. In other words, a total access time to the display memory is reduced, so that the power consumption of this controller driver is reduced.

One of factors which cause increase of power consumption in the controller driver is the increase in a data quantity of display data sent to the controller driver. Since various sorts of information are displayed on the display panel, display data sent to the controller driver increases rapidly. In some case, bit map data having high gradation are sent to the controller driver so as to display a photograph on a display panel. Also, in some case, video image data whose data quantity are large are sent to the controller driver in order to display the video image data on the display panel. In addition, in some case, bit map data of a character image are sent to the controller driver in order to display the character image on the display panels. However, every time a data bit of the display data is received, the controller driver consumes power to some extent. Therefore, the increase of the data quantity of display data directly causes increase of power consumption by the controller driver.

The increase of the data quantity of display data sent to the controller driver is also not preferable from the viewpoint of EMI (electromagnetic interference). However, undesirable radiation of electromagnetic wave from the controller driver cannot be avoided every time the data bit of the display data is received. As a consequence, the reduction of the data quantity of display data is important in suppression of the EMI.

A synthetic image that a background image and a character image are synthesized is one of the reasons why the display data sent to the controller driver increases. In a general controller driver, in order to display the synthetic image newly after a certain image is displayed, for example, for an on-screen display, an entire image to be displayed needs be newly resent to the controller driver.

A controller driver having a function to partially rewrite a displayed image can solve such a problem to some extent. The reason is in that the controller driver can display the synthetic image if only character bit map data to be synthesized is sent to the controller driver.

There is stronger requirement to decrease the data quantity of display data sent to the controller driver. Under such a requirement, provisions of techniques are demanded that the data quantity of display data to be sent to the controller driver having the function for synthesizing the background image and the character image can be further reduced.

SUMMARY OF THE INVENTION

In an aspect of the present invention, a controller driver includes a driving process circuit configured to receive background bit map data of a background image and font data for a character image, and a font drawing circuit configured to generate pixel data of the character image from the font data. The font data for a pixel is described in a format in which a bit length of the font data for the pixel shorter than in a RGB format, and the driving processing circuit displays on a display panel a synthetic image in which the character image is superimposed on the background image in an on-screen display mode, by driving the display panel based on the background bit map data and the pixel data of the character image.

The font data preferably has a stroke font format. Also, the driving processing circuit includes a control circuit sets one of the on-screen display mode, an on-screen display mode with a change of the synthetic image, and a normal display mode based on a received control signal.

In the driving processing circuit, character bit map data as the pixel data of the character image from the font drawing circuit is written in the image display memory in which the background bit map data has been written, to generate the display bit map data. An image display memory stores display bit map data of the synthetic image, a driving circuit drives the display panel based on the display bit map data.

Also, in the driving processing circuit, a font display memory stores character bit map data as the pixel data of the character image, and an image display memory stores the background bit map data. A filter circuit reads out the character bit map data of the character image from the font display memory, reads out the background bit map data from the image display memory, and generates display bit map data of the synthetic image from the read character bit map data and the background bit map data, in the on-screen display mode. A driving circuit drives the display panel based on the bit map data of the synthetic image. In this case, the filter circuit reads out the background bit map data from the image display memory as the display bit map data in the normal display mode different.

Also, in the driving processing circuit, a font display memory stores character bit map data as the pixel data of the character image, and an image display memory stores the background bit map data. A font process memory writes the character bit map data from the font drawing circuit in the font display memory when the character bit map data is completed. A filter circuit reads out the character bit map data of the character image from the font display memory, to read out the background bit map data from the image display memory, and generates display bit map data of the synthetic image from the read character bit map data and the background bit map data, in the on-screen display mode. A driving circuit drives the display panel based on the display bit map data of the synthetic image. In this case, the filter circuit may read out the background bit map data from the image display memory as the display bit map data in the normal display mode.

Also, in the driving processing circuit, a font display memory stores character bit map data as the pixel data of the character image, and an image display memory stores the background bit map data. A font process memory writes the character bit map data from the font drawing circuit in the font display memory when the character bit map data is completed. A calculating circuit reads out the character bit map data from the font display memory in the on-screen display mode. A filter circuit reads out the background bit map data from the image display memory, receives the character bit map data from the calculating circuit, and generates display bit map data of the synthetic image from the received character bit map data and the background bit map data, in the on-screen display mode. A driving circuit drives the display panel based on the display bit map data of the synthetic image. In this case, the filter circuit may transfer the background bit map data to the calculating circuit, in the on-screen display mode with the change of the synthetic image. The calculating circuit may generate calculation bit map data as display bit map data of the synthetic image from the character bit map data stored in the font display memory and the background bit map data, to supply to the driving circuit, in the on-screen display mode with the change of the synthetic image. Also, the filter circuit may transfer the background bit map data as display bit map data of the synthetic image to the driving circuit in a normal display mode.

Also, in the controller driver, the font drawing circuit outputs rectangular area data with a color reference number for each of structural elements of the character image from the font data. In the driving processing circuit, a font display memory stores the color reference numbers for the character image, and an image display memory stores the background bit map data. A font process memory writes the color reference numbers of the rectangular area data from the font drawing circuit in the font display memory when the color reference numbers is completed. A color palette circuit stores color palette data indicating a relation of the color reference number and a color, and a filter circuit generates character bit map data from the color reference numbers by referring to the color palette circuit, reads out the background bit map data from the image display memory, and generates display bit map data from the background bit map and the character bit map data. A driving circuit drives the display panel based on the display bit map data of the synthetic image. In this case, the filter circuit may read out the background bit map data from the image display memory as the display bit map data in the normal display mode. Also, the font drawing circuit may divide the character image into rectangular areas, and generate the rectangular area data to designate a color of the pixels of the character image contained in each of the rectangular areas.

In another aspect of the present invention, a mobile terminal includes the controller driver described in the above.

In another aspect of the present invention, a display panel driving method is achieved by supplying font data and background bit map data to a control driver; and by displaying a synthetic image of the character image and the background image on a display panel based on the background bit map data and the pixel data of the character image by control driver.

Also, the font data has a stroke font format.

BRIEF DESCRIPTION OF THE DRAWINGS

FIG. 11 is a diagram showing color palette data used in the mobile terminal of the fifth embodiment;

DESCRIPTION OF THE PREFERRED EMBODIMENTS

Hereinafter, a controller driver and a display method using the same of the present invention will be described in detail with the attached drawings.

First Embodiment

Figure 1:
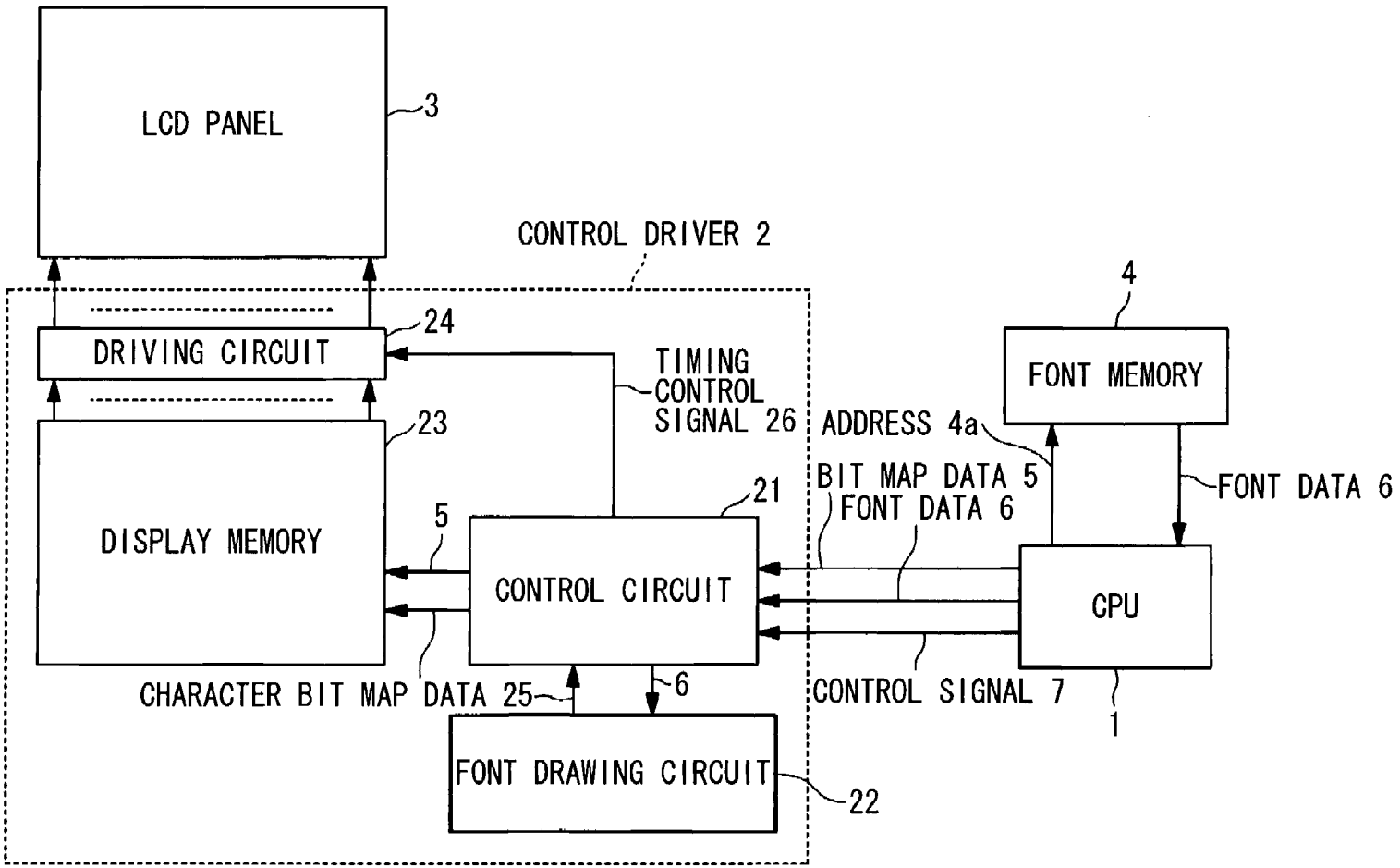
FIG. 1 is a block diagram showing the hardware configuration of a mobile terminal on which a controller driver according to a first embodiment of the present invention is mounted.

FIG. 1 is a block diagram showing the hardware configuration of a mobile terminal on which a controller driver 2 according to the first embodiment of the present invention is mounted. The controller driver 2 in the first embodiment has a function to draw a character (font) image on a background image after the background image is displayed. The mobile terminal is provided with a CPU 1, the controller driver 2, an LCD panel 3, and a font memory 4. The CPU 1 supplies display data of an image to be displayed on the LCD panel 3, and a control signal 7 to the controller driver 2. The controller driver 2 drives the LCD panel 3 based on the display data in response to the control signal 7. The LCD panel 3 contains a plurality of pixels arranged in a matrix. The LCD panel 3 is driven by the controller driver 2 to display a desirable image.

Two sorts of display data are supplied from the CPU 1 to the controller driver 2, one sort of the display data is background bit map data 5 of a background image to be displayed on the LCD panel 3, and the other sort of the display data is font data 6 of a character image to be superimposed on the background image. The background bit map data 5 is pixel data defined in the RGB format, namely, is RGB data indicative of R (red), G (green), and B (blue) gradation levels of the respective pixels.

The font data 6 is data indicative of a shape and color of a character image to be displayed, and has a stroke font format. Therefore, a data quantity of the font data 6 having the stroke font format is smaller than that of the font data having the bit map format. In the stroke font format, a character is represented by a shape of a center line and a sort of a line, including a color of the line. The use of the stroke font format is preferable in that the data quantity of the font data 6 can be considerably made small. For instance, when a character is displayed in the pixel size of 13×13 pixels in the bit map format, the data quantity of font data defined in the stroke font format is nearly equal to ¼ of the data quantity of font data defined in the bit map format.

The font data 6 is constituted of commands which designates the color of the character to be displayed and the shape of a structural element contained in the character. When the stroke font format is used as the format for defining the font data 6, commands for the font data 6 contain coordinates of control points of the character to be displayed, a description of a sort of a line to connect the control points, and another description of a color of the character, in the most typical example. Alternatively, the font data 6 may be described in an outline font format. In this case, the font data 6 is constituted from a command indicating a contour line of the character, and a color to be painted inside the contour line.

To produce the font data 6, the font memory 4 is used. The font data of all the characters which can be displayed are previously stored in the font memory 4. When a character is to be displayed in an on-screen display, the CPU 1 calculates an address 4*a* of the font memory 4 from a character code of the character, and acquires the font data 6 of the character to be displayed from the calculated address 4*a* of the font memory 4.

The controller driver 2 drives the LCD panel 3 based on the background bit map data 5, and the font data 6 in response to the control signal 7, which are sent from the CPU 1. When the font data 6 is supplied from the CPU 1, the controller driver 2 superimposes a character image corresponding to the font data 6 on a background image corresponding to the background bit map data 5.

In order to carry out the above-mentioned operation, the controller driver 2 contains a control circuit 21, a font drawing circuit 22, a display memory 23, and a driving circuit 24. The control circuit 21 controls various circuits contained in the controller driver 2 in response to the control signal 7 sent from the CPU 1. More specifically, the control circuit 21 transfers the display data sent from the CPU 1 and control data described in the control signal 7 to proper destinations. The bit map data 5 is written in the display memory 23, and the font data 6 is sent to the font drawing circuit 22. Further, the control circuit 21 carries out a timing control operation between the display memory 23 and the driving circuit 24.

The font drawing circuit 22 produces character bit map data 25 of the character image to be displayed from the font data 6. The character bit map data 25 is constituted from pixel data of pixels of the character image to be displayed, and is described in the RGB format.

The display memory 23 stores both of the background bit map data 5 of the background image, and the character bit map data 25 of the character image to be superimposed on the background image. For the superimposition of the character image on the background image, the pixel data in a portion of the background bit map data 5 corresponding to the character image are rewritten into the pixel data of the character bit map data 25.

The driving circuit 24 sequentially reads out the display bit map data from the display memory 23, and drives data lines (not shown) of the LCD panel 3 based on the read display bit map data. The drive timings of the data lines of the LCD panel 3 are instructed based on a timing control signal 26 which is sent from the control circuit 21.

Figure 2:
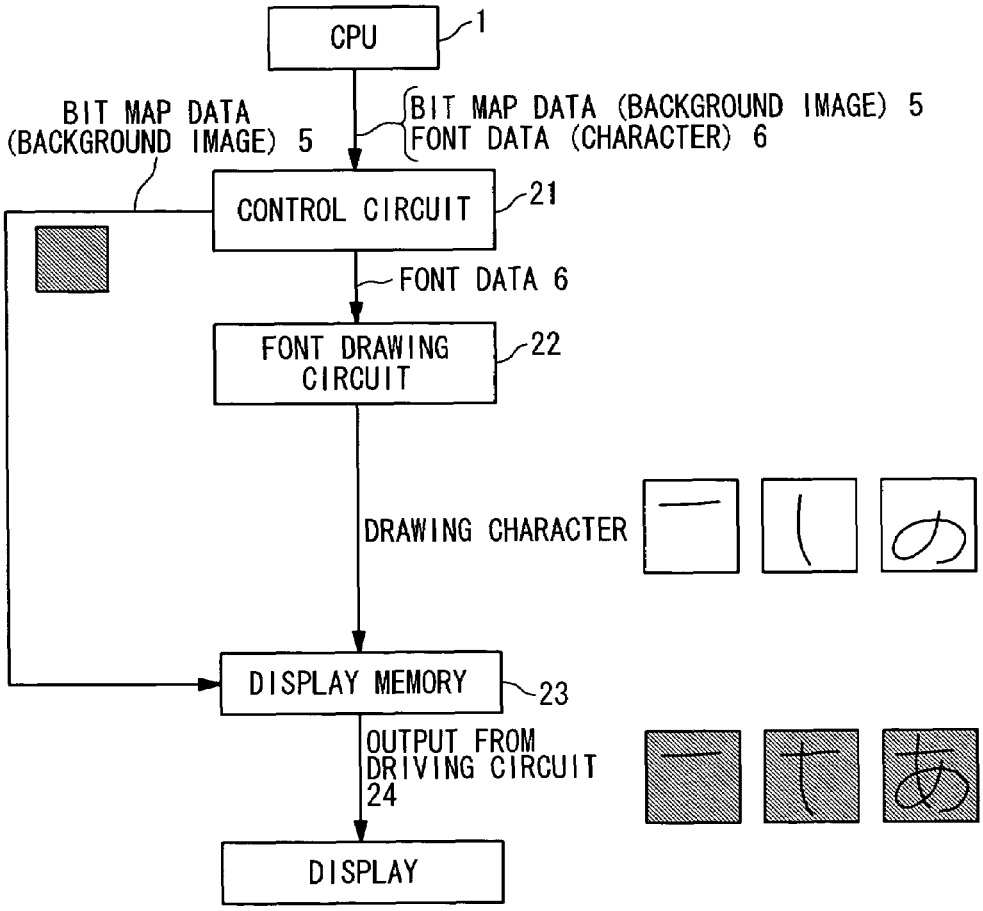
FIG. 2 is a block diagram showing an operation of the controller driver in the first embodiment when a on-screen display is carried out.

FIG. 2 is a block diagram showing an operation of the controller driver 2 in the first embodiment.

When both of the background bit map data 5 of the background image and the font data 6 of the character image to be superimposed on the background image are sent from the CPU 1 to the control circuit 21, the control circuit 21 sends the background bit map data 5 to the display memory 23 and the font data 6 to the font drawing circuit 22. The background bit map data 5 is written in the display memory 23. In this case, the frequency of a clock signal to be supplied to the font drawing circuit 22 is lower than that of a clock signal to be supplied to the CPU 1.

The font drawing circuit 22 sequentially interprets commands contained in the font data 6, and sequentially produces pixel data of structural elements of the character image to be displayed. The bit map data corresponding to the structural elements of the character image are sequentially sent to the display memory 23 under control of the control circuit 21. The pixel data of the background bit map data 5 in the display memory 23 which correspond to the pixels of the character image are rewritten with the pixel data of the character image. Such an operation will be sometimes referred to as "drawing of characters" hereinafter. A set of the pixel data sent from the font drawing circuit 22 to the display memory 23 is the character bit map data 25. As a result of completion of "drawing of characters", the character bit map data 25 is produced in the display memory 23.

The driving circuit 24 sequentially reads out the display bit map data (namely, background bit map data 5, a portion of which has been rewritten) from the display memory 23, and drives the LCD panel 3.

In the first embodiment, the font data 6 sent from the CPU 1 to the controller driver 2 is described in a format that the data quantity of the font data 6 is smaller than that of the bit map font format, typically, is described in the stroke font format. As a consequence, the data quantity of the bit map data sent from the CPU 1 to the controller driver 2 to superimpose the character image on the background image is small, so that the reduction of the power consumption of the controller driver 2 and the decrease of EMI can be achieved.

Second Embodiment

Figure 3:
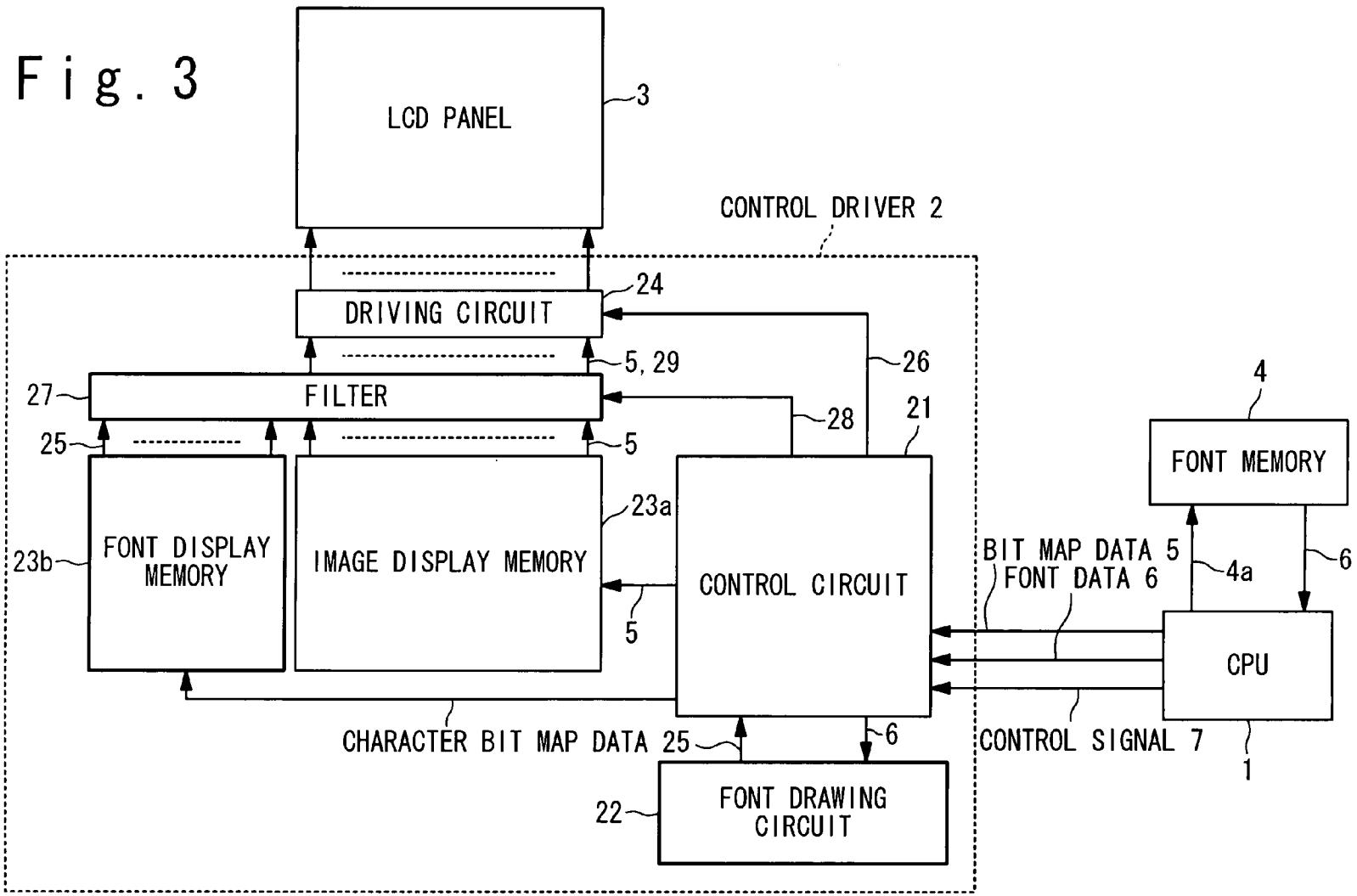
FIG. 3 is a block diagram showing the hardware configuration of the mobile terminal on which a controller driver according to a second embodiment of the present invention is mounted.

FIG. 3 is a block diagram showing the hardware configuration of the mobile terminal on which the controller driver 2 according to the second embodiment of the present invention is mounted. The controller driver 2 in the second embodiment realizes a suitable on-screen display while a data quantity of data sent from the CPU 1 to the controller driver 2 is suppressed. The on-screen display implies a display method that a character image is superimposed on a background image, and when the display of the character image is not required, the character image is deleted. In order to realize the on-screen display, the controller driver 2 in the second embodiment contains an image display memory 23*a* and a font display memory 23*b* instead of the display memory 23 in the first embodiment, and further the controller driver 2 additionally contains a filter 27.

The image display memory 23*a* is used to store the background bit map data 5 of the background image, whereas the font display memory 23*b* is used to store the character bit map data 25 produced by the font drawing circuit 22, independently from the background bit map data 5. Also, when the character image is superimposed on the background image, the background bit map data 5 in the image display memory 23*a* is not rewritten.

The filter 27 carries out a calculation for superimposing the character image on the background image in response to a control signal 28 sent from the control circuit 21. When an on-screen display request is issued as the control signal 28 from the control circuit 21, the filter 27 reads out the background bit map data 5 from the image display memory 23*a* one line by one line. Further, the filter 27 reads out the character bit map data 25 from the font display memory 23*b* one line by one line, and then produces synthetic bit map data 29 for a character image superimposed background image as a synthetic image from the read background bit map data 5 and the read character bit map data 25. The synthetic bit map data 29 is constituted from pixel data of the character image superimposed background image as a display image, and is described in the RGB format.

On the other hand, when the display of the background image is requested by the control signal 28, the filter 27 reads out the background bit map data 5 from the image display memory 23*a* and directly supplies the read background bit map data 5 to the driving circuit 24.

The driving circuit 24 receives either the synthetic bit map data 29 or the background bit map data 5 from the filter 27, and drives the LCD panel 3 based on the received bit map data 29 or 5. When the driving circuit 24 drives the LCD panel 3 based on the synthetic bit map data 29, the on-screen display of the character is realized. When the driving circuit 24 drives the LCD panel 3 based on the background bit map data 5, only the background image is displayed.

Figure 4:
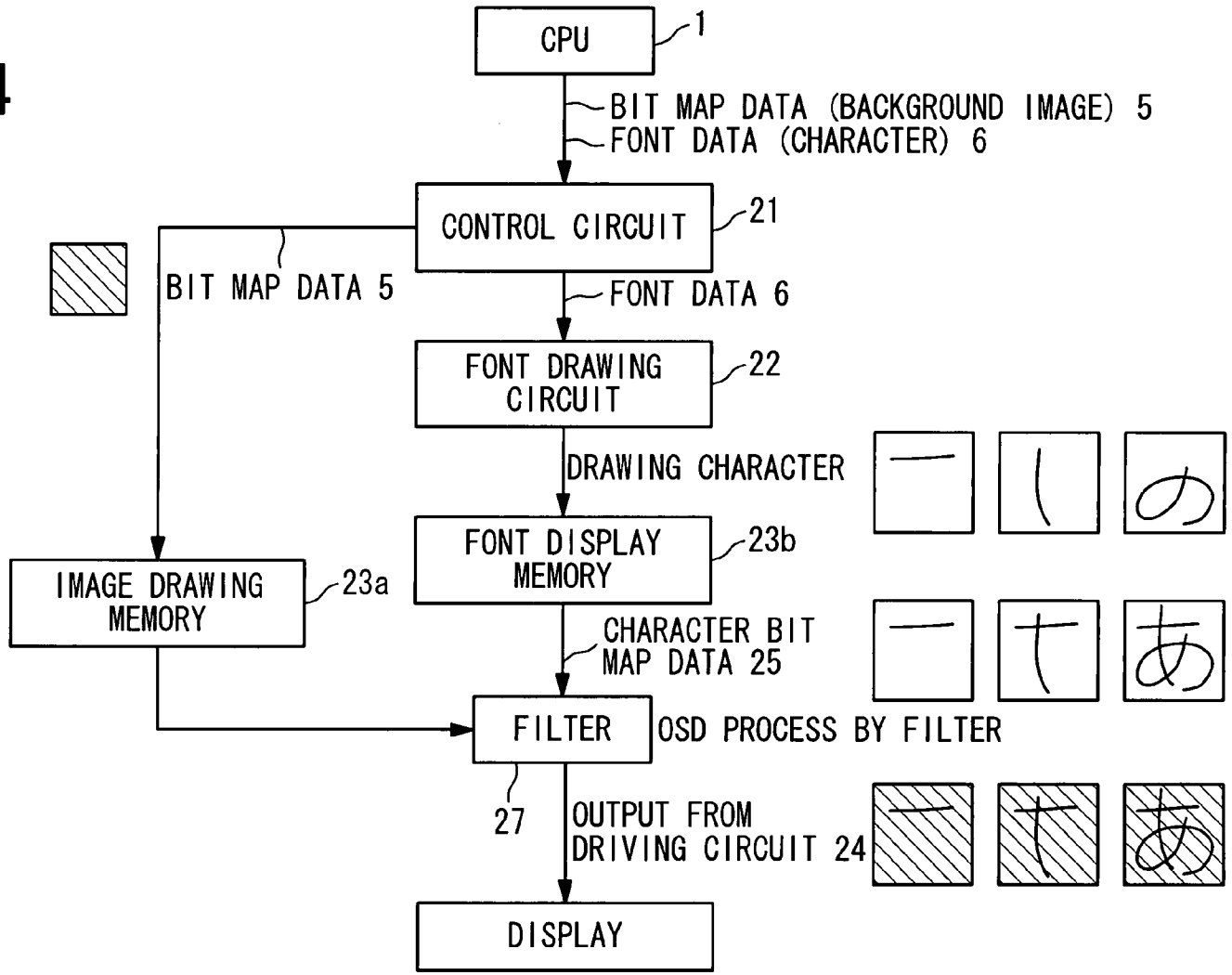
FIG. 4 is a flow diagram showing an operation of the controller driver in the second embodiment when the on-screen display is carried out.

FIG. 4 is a flow diagram showing an operation of the controller driver 2 in the second embodiment when the on-screen display is carried out.

When both of the background bit map data 5 of the background image and the font data 6 of the character image to be superimposed on the background image are sent from the CPU 1 to the control circuit 21, the control circuit 21 sends the background bit map data 5 to the image display memory 23*a* and the font data 6 to the font drawing circuit 22. The background bit map data 5 is written in the image display memory 23*a*.

The font drawing circuit 22 sequentially interprets commands contained in the font data 6, and reproduces the character image to be displayed. The font drawing circuit 22 sequentially sends pixel data of the character image to the font display memory 23*b* through the control circuit 21, for "drawing of characters". As a result of the completion of the "drawing of characters", the character bit map data 25 is produced in the front display memory 23*b*.

The filter 27 reads the background bit map data 5 from the image display memory 23*a* and the character bit map data 25 from the font display memory 23*b*, and then produces the synthetic bit map data 29. As described above, the synthetic bit map data 29 is the bit map data of the background bit map data 5, a portion of which is written with the pixel data of the character bit map data 25. The driving circuit 24 drives the LCD panel 3 based on the synthetic bit map data 29 sent from the filter 27, so that the on-screen display of the character image can be achieved.

Similar to the first embodiment, in the second embodiment, the data quantity of the display data is made small, which is sent from the CPU 1 to the controller driver 2 for the superimposition of the character image on the background image. As a result, the reduction of both the power consumption of the controller driver 2 and EMI can be achieved. Especially, the controller driver 2 in the second embodiment is effective when only the font data is rewritten.

Further, in the second embodiment, since the background bit map data 5 is stored in the image display memory 23*a* and the character bit map data 25 is stored in the font display memory 23*b*, the suitable on-screen display can be realized. In the second embodiment, since the background bit map data 5 and the character bit map data 25 are separately stored, the background bit map data 5 and the character bit map data 25 can be independently rewritten. In other words, the background image and the character can be separately rewritten. This feature improves flexibility of the on-scream display.

The control driver 2 in the second embodiment has a function to rewrite only the background image of the synthetic image of the background image and the character image, which is advantageous from the viewpoint of reduction of the processing operation of the CPU 1. In a general controller driver, in order to rewrite only the character image, a calculation for producing a synthetic image of the background image and the character image must be carried out by a CPU, and then the synthetic image must be sent to the controller driver by the CPU. This increases a calculation quantity of the CPU. However, since the control driver 2 in the second embodiment has the function to rewrite only the character image of the synthetic image, the calculation quantity of the CPU 1 can be reduced. In addition, the controller driver 2 in the second embodiment can synthesize the character image and the background image in units of lines, so that the calculation speed for the synthesizing operation can be improved.

Also, in the second embodiment, since the filter 27 is controlled in response to the control signal 28, the character image can be displayed or deleted without rewriting the image display memory 23*a* and the font display memory 23*b*. As a result, the data calculation quantity necessary to start and end the on-screen display can be decreased. In the control driver 2 in the first embodiment, in order to start and end the on-screen display, a data process is required to rewrite a portion of the background image corresponding to the character image to be displayed or deleted. On the other hand, in the second embodiment, such a data process is no longer required. Since the rewriting operation into the image display memory 23*a* and the font display memory 23*b* are not carried out, there is a merit that the power consumption can be reduced.

Third Embodiment

Figure 5:
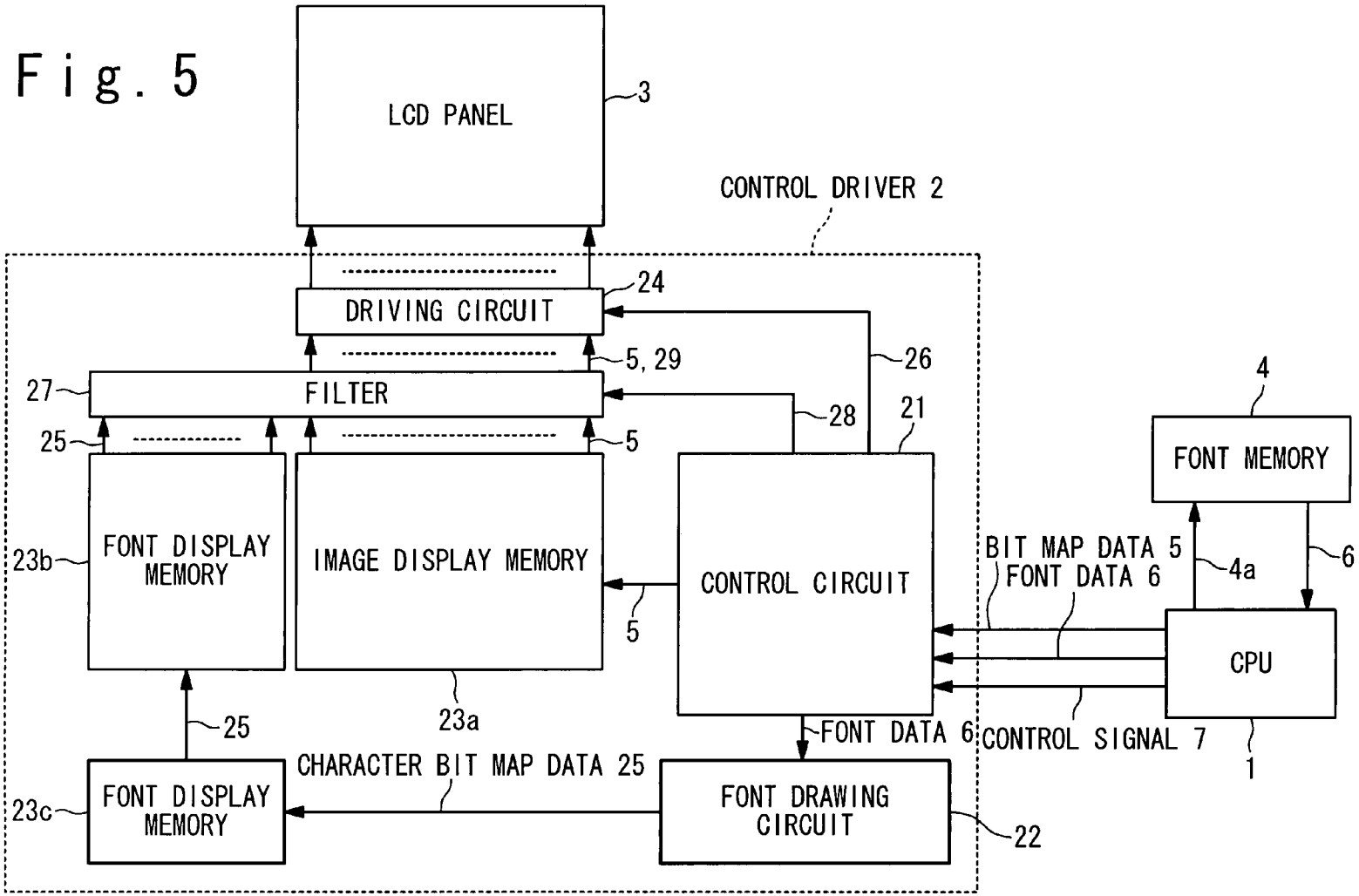
FIG. 5 is a block diagram showing the hardware configuration of the mobile terminal on which the controller driver according to a third embodiment of the present invention is mounted.

FIG. 5 is a block diagram showing the hardware configuration of the mobile terminal on which the controller driver 2 according to the third embodiment of the present invention is mounted. In the controller driver 2 in the third embodiment, a font process memory 23*c* is additionally provided. The font process memory 23 is used as a work area when the front drawing circuit 22 carries out "drawing of characters", namely, the font drawing circuit 22 produces the character bit map data 25. It could be understood that the hardware configuration of the controller driver 2 according to the third embodiment is identical to the arrangement of the controller driver 2 in the second embodiment except that the font process memory 23*c* is newly provided.

The front process memory 23*c* is provided to avoid that an incomplete character image is displayed on the LCD panel 3. As described above, "drawing of characters" is carried out by sequentially interpreting the commands contained in the font data 6. For this reason, the character bit map data 25 is not completed until "drawing of characters" has been completed. The time period required to carry out "drawing of characters" cannot be neglected, as compared with a refresh cycle time of the LCD panel 3. As a consequence, in the controller driver 2 of the second embodiment, the bit map data of the structural elements of the character are sometimes read, and the LCD panel 3 may be driven based on the read bit map data before the character bit map data 25 of the character image to be displayed is completed. This LCD drive operation results in the display of an incomplete character image on the LCD panel 3. However, the font process memory 23*c* eliminates such an incomplete character display. In the third embodiment, "drawing of characters" is completed, and then the complete character bit map data 25 is produced in the font process memory 23*c*. Thereafter, the produced character bit map data 25 is transferred to the font display memory 23*b*. Thus, the on-screen display is achieved based on the complete character bit map data 25 stored in the font display memory 23*b* by using both the filter 27 and the driving circuit 24. As a result, it can be avoided that the incomplete character image is displayed on the LCD panel 3.

Figure 6:
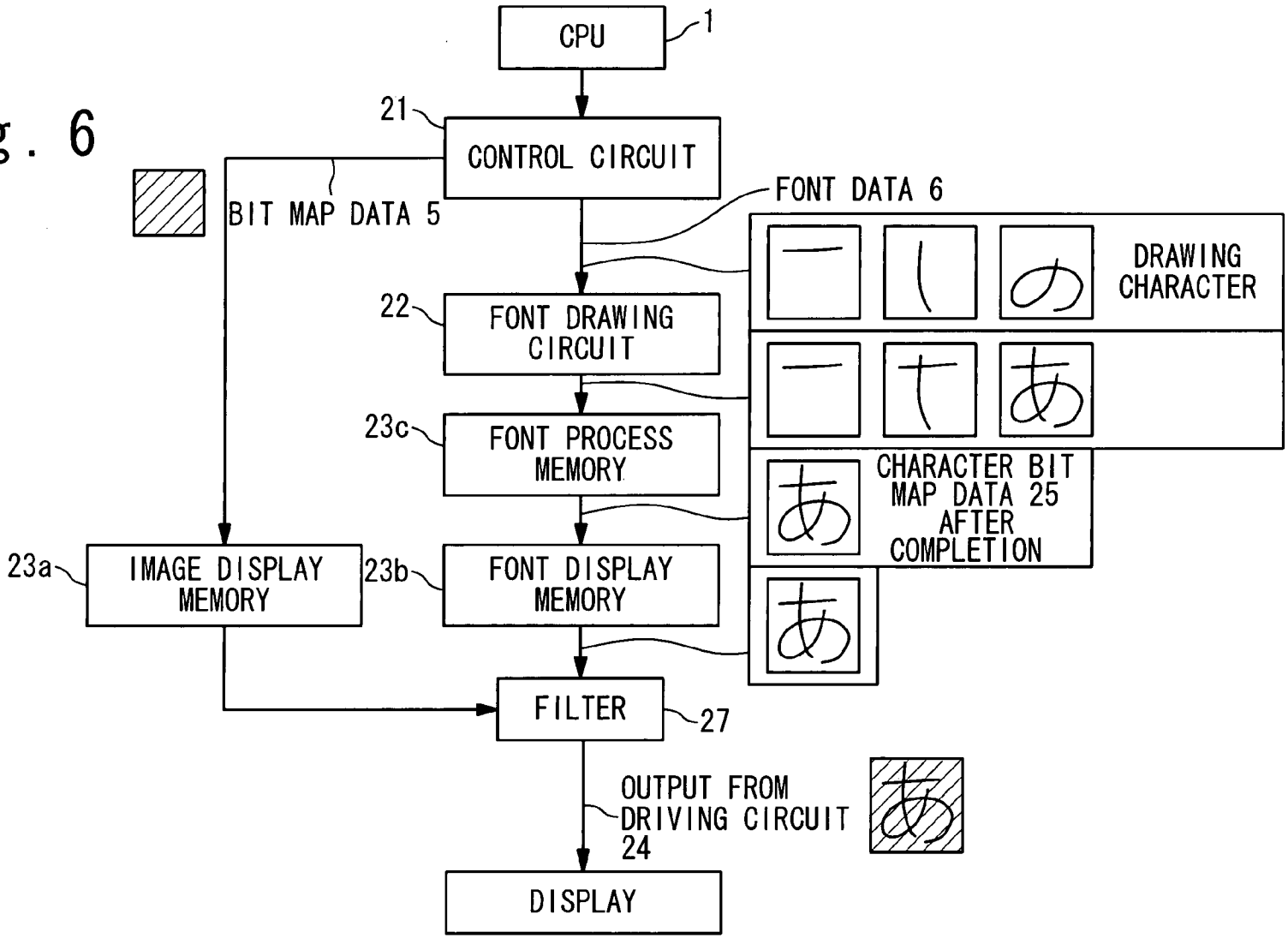
FIG. 6 is a block diagram showing an operation of the controller driver according to the third embodiment when the on-screen display is carried out.

FIG. 6 is a block diagram showing an operation of the controller driver 2 according to the third embodiment when the on-screen display is carried out.

When of the background bit map data 5 of the background image and the font data 6 of the character image to be superimposed on the background image are sent from the CPU 1 to the control circuit 21, the control circuit 21 sends the background bit map data 5 to the image display memory 23*a* and the font data 6 to the font drawing circuit 22. The background bit map data 5 is written in the image display memory 23*a*.

The font drawing circuit 22 sequentially interprets commands contained in the font data 6, and sequentially produces pixel data of structural elements of the character image to be displayed. The pixel data of the character image are sequentially sent to the font process memory 23*c*. When the sending operation of the pixel data of the character image to be displayed to the font process memory 23*c* is accomplished, the character bit map data 25 is completed in the font process memory 23*c*, namely "drawing of character" is completed.

After the character bit map data 25 has been completed in the font process memory 23*c*, the character bit map data 25 is transferred to the font display memory 23*b*. The transfer operation of the character bit map data 25 to the font display memory 23*b* is carried out in a short time, as compared with the refresh cycle of the LCD panel 3.

After the transfer operation of the character bit map data 25 has been accomplished, the filter 27 reads the background bit map data 5 from the image display memory 23*a*, and reads the character bit map data 25 from the font display memory 23*b*. The filter 27 produces the synthetic bit map data 29 from the background bit map data 5 and the character bit map data 25, and then outputs the synthetic bit map data 29 to the driving circuit 24. The driving circuit 24 drives the LCD panel 3 based on the synthetic bit map data 29, so that the on-screen display of the character image can be achieved.

Similar to the first embodiment, in the third embodiment, the data quantity of the display data is made small, which is sent from the CPU 1 to the controller driver 2 for the superimposition of the character image on the background image, so that the reduction of the power consumption of the controller driver 2 and EMI can be achieved.

In addition, in the third embodiment, since the font process memory 23*c* is provided in addition to the font display memory 23*b*, it is possible to avoid that an incomplete character is displayed on the LCD panel 3.

Fourth Embodiment

Figure 7:
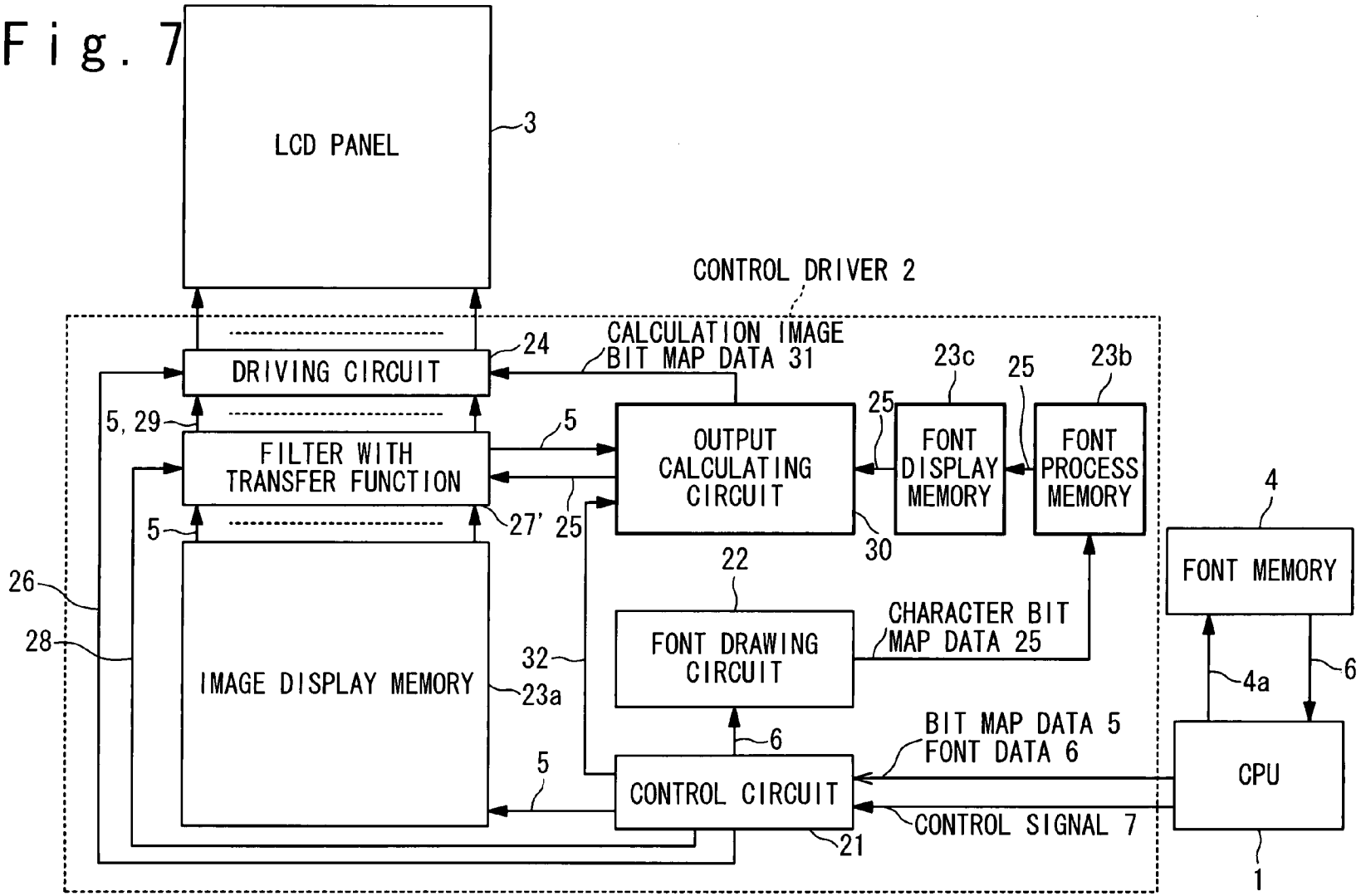
FIG. 7 is a block diagram showing the hardware configuration of the mobile terminal on which the controller driver according to a fourth embodiment of the present invention is mounted.

FIG. 7 is a block diagram showing the hardware configuration of the mobile terminal on which the controller driver 2 according to the fourth embodiment of the present invention is mounted. In the controller driver 2 of the fourth embodiment, an output calculating circuit 30 is additionally provided. The output calculating circuit 30 carries out a calculation other than the superimposition of the character image of the character bit map data 25 on the background image of the background bit map data 5. The calculation carried out by the output calculating circuit 30 typically contains an alpha (a) blend, anti-aliasing, and movement of the character image. The output calculating circuit 30 calculates and produces calculation image bit map data 31 from the background bit map data 5 and the character bit map data 25.

Since the output calculating circuit 30 is mounted on the controller driver 2, the operations of the CPU 1, control circuit 21, and filter 27 are changed. The CPU 1 notifies a calculation to be carried out by the output calculating circuit 30 to the control circuit 21 by way of the control signal 7. The control circuit 21 supplies a calculation control signal 32 to the output calculating circuit 30 in response to the control signal 7, and the calculation control signal 32 designates a calculation to be carried out by the output calculating circuit 30. In order to allow the calculation of the background bit map data 5 by the output calculating circuit 30, the operation of the filter 27 is changed in such a manner that the background bit map data 5 is read out from the image display memory 23*a* and transferred to the output calculating circuit 30. The filter 27 whose operation has been changed will be referred to as a "filter 27'with a transfer function" hereinafter. The filter 27' can carry out the following operation in response to the control signal 28, that is, the filter 27' directly outputs the background bit map data 5 to the driving circuit 24, or supplies the background bit map data 5 to the output calculating circuit 30, in response to the control signal 28. In addition, in response to the control signal 28, the filter 27' reads out the background bit map data 5 from the image display memory 23*a*, receives the character bit map data 25 from the font display memory 23*c* through the output calculating circuit 30 and superimposes the received character bit map data 25 on the read background bit map data 5 to produce the synthetic bit map data 29.

The output calculating circuit 30 can carry out a random access operation to the font display memory 23*c*. The random access operation is very important in order to carry out an arbitrary calculation of the background bit map data 5 and the character bit map data 25, especially to carry out a calculation for parallel movement of the character image.

Figure 8:
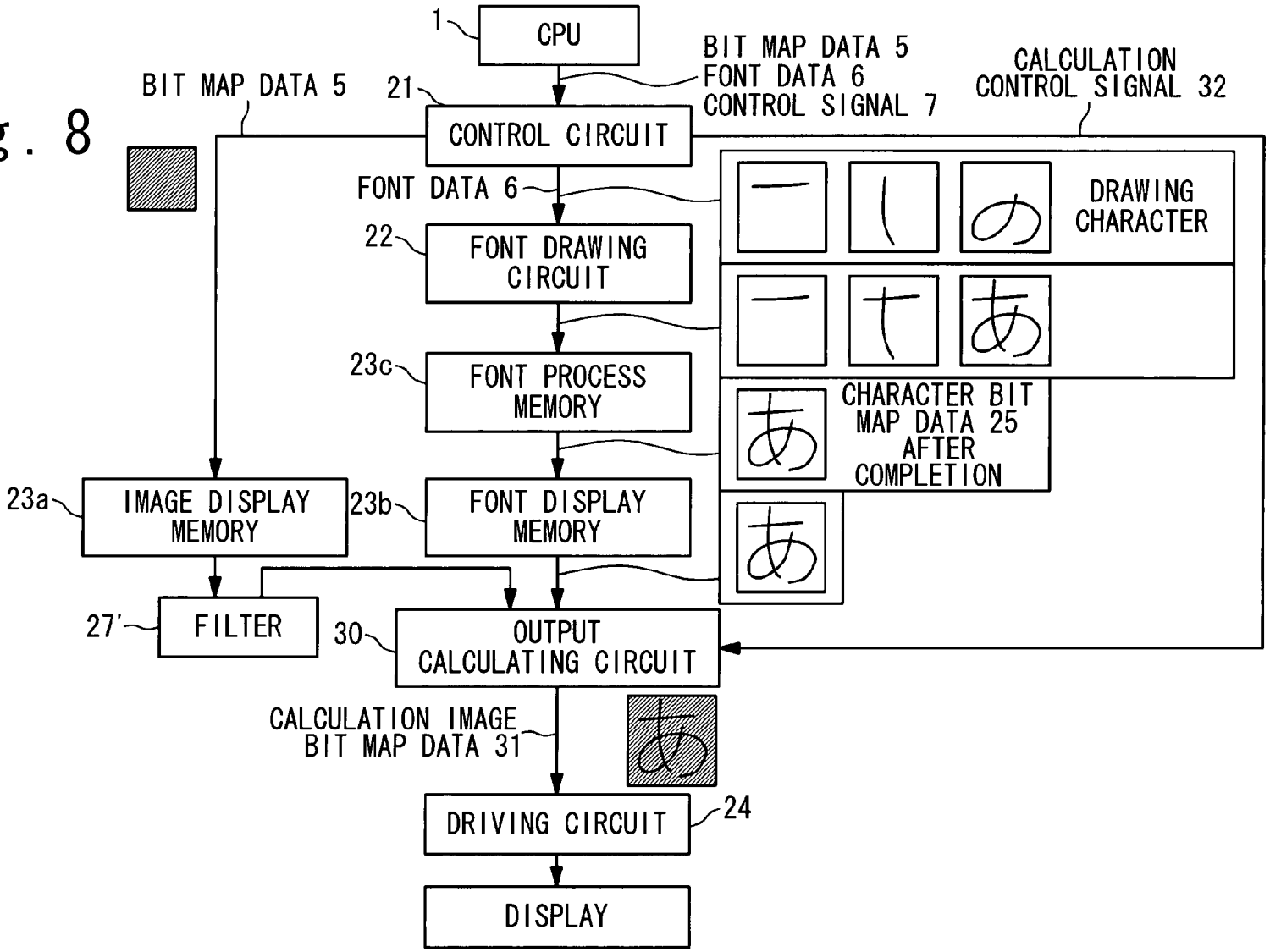
FIG. 8 is a block diagram showing an operation of the controller driver when the calculation between background bit map data and character bit map data is carried out by an output calculating circuit.

FIG. 8 is a block diagram showing the operation of the controller driver 2 when the calculation between the background bit map data 5 and the character bit map data 25 is carried out by the output calculating circuit 30.

When the background bit map data 5 of the background image, the font data 6 of the character image to be superimposed on the background image, and the control signal 7 are sent from the CPU 1, the control circuit 21 sends the background bit map data 5 to the image display memory 23*a* and sends the font data 6 to the font drawing circuit 22. The background bit map data 5 is written in the image display memory 23*a*. Further, the control circuit 21 sends the calculation control signal 32 to the output calculating circuit 30 in response to the control signal 7, and the calculation control signal 32 designates the calculation to be carried out by the output calculating circuit 30.

The transferring operation of the character bit map data 25 to the font display memory 23*b* and the producing operation of the character bit map data 25 are carried out in a similar manner to those of the third embodiment. The font drawing circuit 22 sequentially interprets the commands contained in the front data 6, and sequentially produces pixel data of structural elements of the character image to be displayed. The pixel data of the character image are sequentially sent to the font process memory 23*c*. When the transfer operation of the pixel data of the character image to be displayed to the font process memory 23*c* is accomplished, the character bit map data 25 is completed in the font process memory 23*c*, namely "drawing of character" is completed. After the character bit map data 25 has been completed in the font process memory 23*c*, the character bit map data 25 is transferred to the font display memory 23*b*.

The filter 27' reads out the background bit map data 5 from the image display memory 23*a*, and transfers the read background bit map data 5 to the output calculating circuit 30. The output calculating circuit 30 receives the background bit map data 5 from the filter 27' and the character bit map data 25 from the font display memory 23*b* respectively. Further, the output calculating circuit 30 carries out a calculation designated by the calculation control signal 32 to the received bit map data to produce the calculation bit map data 31.

Based on the calculation bit map data 31, the driving circuit 24 drives the LCD panel 3. As a result, a display image that the character image and the background image have been calculated is displayed on the LCD panel 3.

Figure 9:
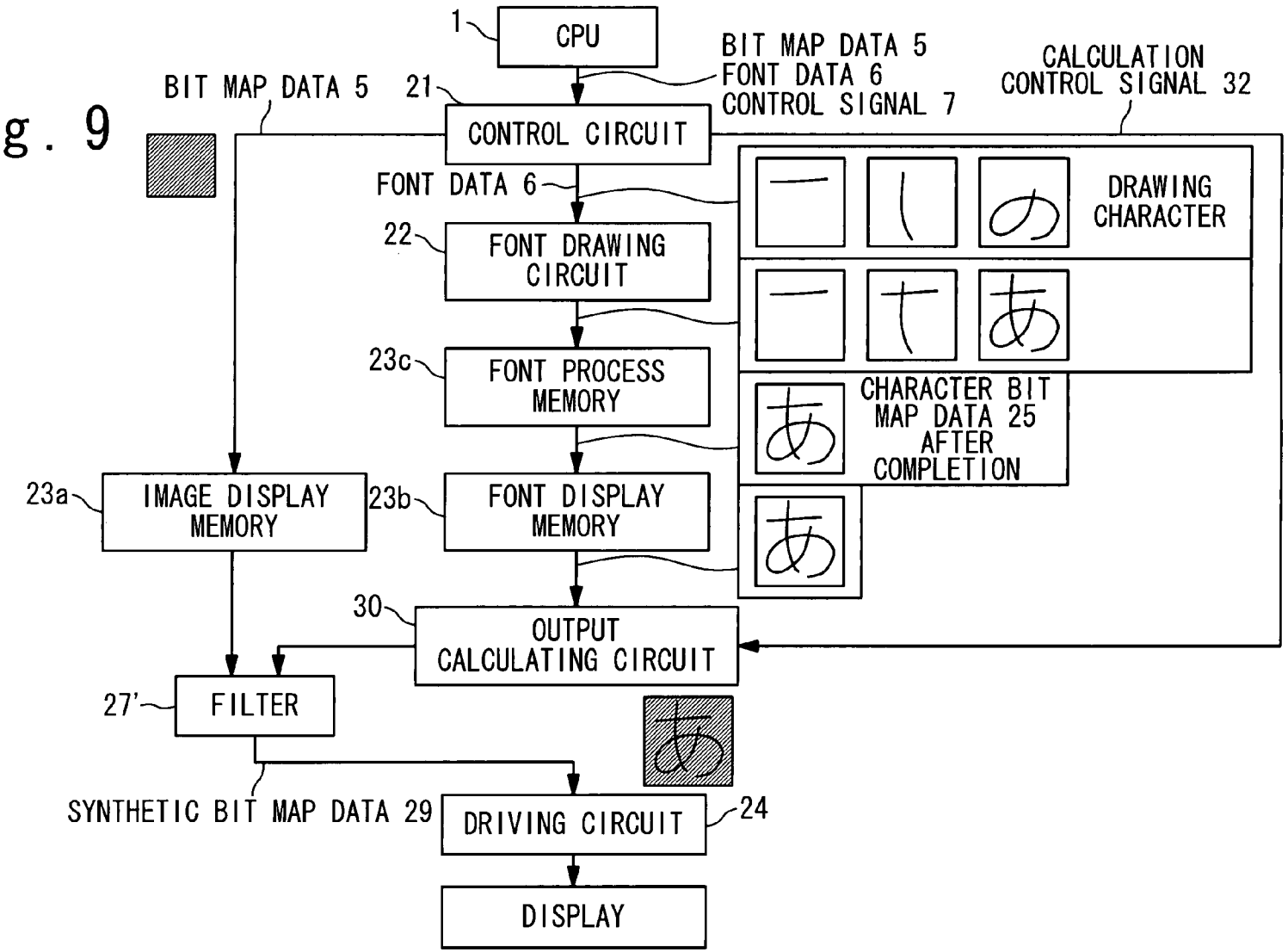
FIG. 9 is a block diagram showing an operation of the controller driver when a character image is merely displayed on a background image in the on-screen display.

FIG. 9 is a block diagram showing an operation of the controller driver 2 when the character image is merely displayed on the background image in the on-screen display.

When the background bit map data 5 of the background image, the font data 6 of the character image to be superimposed on the background image, and the control signal 7 are sent from the CPU 1, the control circuit 21 sends the background bit map data 5 to the display memory 23 and sends the font data 6 to the font drawing circuit 22. The background bit map data 5 is written in the image display memory 23*a*. The transferring operation of the character bit map data 25 to the font display memory 23*b* and the producing operation of the character bit map data 25 are carried out in a similar manner to those of the third embodiment. Further, the control circuit 21 sends the calculation control signal 32 to the output calculating circuit 30 in response to the control signal 7, to designate that the calculation is not carried out by the output calculating circuit 30.

In response to the calculation control signal 32, the output calculating circuit 30 reads out the character bit map data 25 from the font display memory 23*b*, and supplies the read character bit map data 25 to the filter 27'. The filter 27' reads out the background bit map data 5 from the image display memory 23*a*. In addition, the filter 27' produces the synthetic bit map data 29 from the background bit map data 5 and the character bit map data 25, and outputs the synthetic bit map data 29 to the driving circuit 24. Based on the synthetic bit map data 29, the driving circuit 24 drives the LCD panel 3, so that the on-screen display of the character image can be achieved.

Similar to the first embodiment, in the fourth embodiment, the data quantity of the display data is made small, which is sent from the CPU 1 to the controller driver 2 for the superimposition of the character image on the background image, so that the reduction of both the power consumption of the controller driver 2 and EMI can be achieved.

Moreover, the controller driver of the fourth embodiment can carry out the desirable calculation to both the character image and the background image in addition to the on-screen display.

Fifth Embodiment

Figure 10:
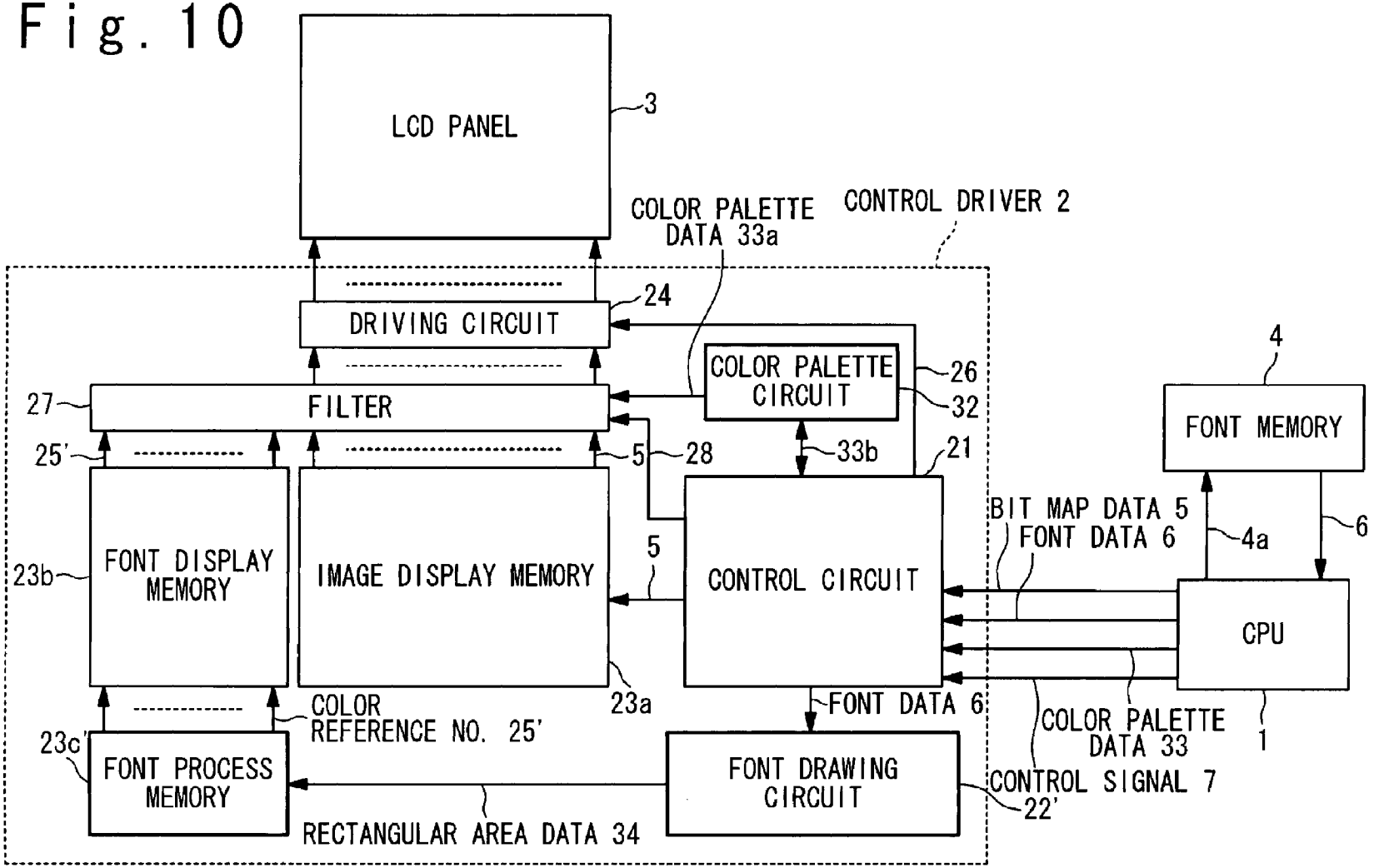
FIG. 10 is a block diagram showing the hardware configuration of the mobile terminal on which the controller driver according to a fifth embodiment of the present invention is mounted.

FIG. 10 is a block diagram showing the hardware configuration of the mobile terminal on which the controller driver 2 according to the fifth embodiment of the present invention is mounted. The controller driver 2 in the fifth embodiment has a substantially same configuration as that of the controller driver 2 in the third embodiment shown in FIG. 5. The configuration and operation of the controller driver 2 in the fifth embodiment are changed with respect to the following two features, i.e., reduction of a storage capacity of a memory provided in the controller driver 2 and a high speed process of the display data.

That is, as the first feature of the controller driver 2, the pixel data of the character image stored in the font display memory 23*b* and the font process memory 23*c* are described by not the RGB format, but color reference numbers. The color reference number is n-bit data to designate a color of the pixel. In other words, in the fifth embodiment, the character bit map data 25 are not stored in the font display memory 23*b* and the font process memory 23*c*, but the color reference number data 25' are stored in these memories 23*b* and 23*c*. The color reference number data 25' indicate the respective colors of the pixels for the character image. The number n of bits of the color reference number described in the color reference number data 25' is selected to be smaller than the number of bits of the RGB data of the background bit map data 5. As a result, the storage capacities of the font display memory 23*b* and font process memory 23*c* can be decreased, as compared with a case that colors of the pixels of the character image are designated in the format of RGB data.

The font drawing circuit 21 sequentially interprets the commands of font data 6 to carry out "drawing of characters", and completes the color reference number data 25' in the font process memory 23*c*. The color reference number data 25' is transferred to the font display memory 23*b*.

The color reference number data 25' described in the format of the color reference number cannot be calculated with the background bit map data 5*a* described in the format of the RGB data without changing the format. It is not convenient since the synthetic bit map data 29 described in the format of the RGB data is required to be produced in order to carry the on-screen display in which the character image is superimposed on the background image.

For solving the above inconvenience, a color palette circuit 32 is provided in the controller driver 2 of the fifth embodiment. Color palette data 33*b* is stored in the color palette circuit 32 to describe a correspondence relationship between the color reference number and the RGB data designated by the color reference number. FIG. 11 is a diagram showing conception of the color palette data 33*b*. For example, the color reference number "1" denotes the RGB data of "blue", the color reference number "2" denotes the RGB data of "red", and the color reference number "3" denotes the RGB data of "yellow". The color palette data 33*b* may be fixed, or may be supplied from the CPU 1, which is suitable for display of various colors of character images.

Referring back to FIG. 10, the filter 27 calculates the color reference number data 25' with the background bit map data 5*a* by using the color palette data 33*b*. The filter 27 converts the color reference number data 25' of the character image into character RGB data 33*a* by using the color palette data 33*b*. Further, the filter 27 calculates the character RGB data with the RGB data of the background bit map data 5*a* to produce the synthetic bit map data 29.

The second feature of the controller driver 2 of the fifth embodiment is as follows. That is, when the pixel data of the character image is written in the font process memory 23*c*, a plurality of rows and columns of the pixel data of the character image are written in the font process memory 23*c* at a same time, by utilized that one character is normally drawn in a single color. More specifically, the hardware configuration of both of the font drawing circuit 22 and font process memory 23*c* are changed in such a manner that the plurality of rows and columns of the pixel data can be simultaneously written in them. It should be noted that the font drawing circuit and the font process memory after the change of the configuration are indicated as a "font drawing circuit 22'''" and a "font process memory 23*c*'''" in FIG. 10. The font drawing circuit 22' grasps a shape of the character image to be displayed based on the font data 6, and separates the character image into rectangular areas to produce rectangular area data 34 for each rectangular area. In addition, the font drawing circuit 22' sends the rectangular area data 34 to the font process memory 23*c*'. One of the rectangular area data 34 contains an x-coordinate "x0" and a y-coordinate "y0" of the center of the rectangular area, a width "W" of a horizontal direction (x direction) and a height "h" of a vertical direction (y direction), and a color reference number to designate a color of pixels contained in the rectangular area. The font process memory 23*c*' simultaneously writes the color reference numbers of all the pixels contained in the rectangular area into memory cells based on the rectangular area data 34. The configuration allows the color reference number data 25' to be written in the font process memory 23*c*' in a high speed.

Figure 12A:
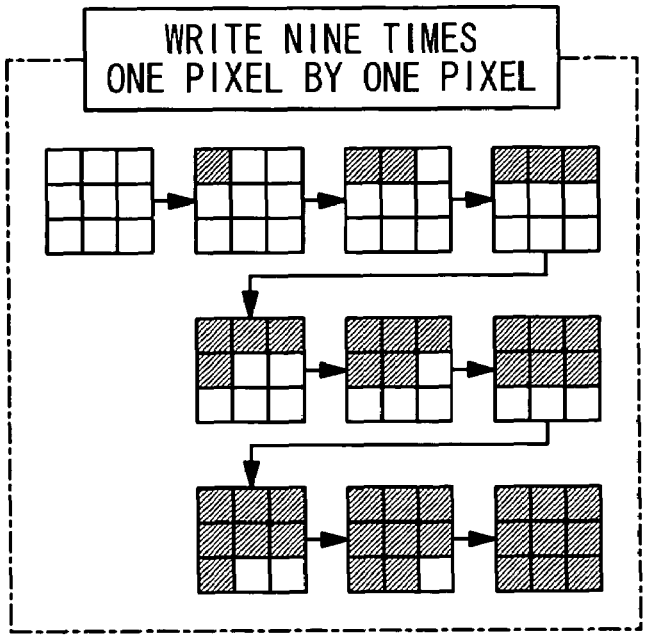
FIG. 12A is a diagram showing a write operation in a typical frame memory.
Figure 12B:
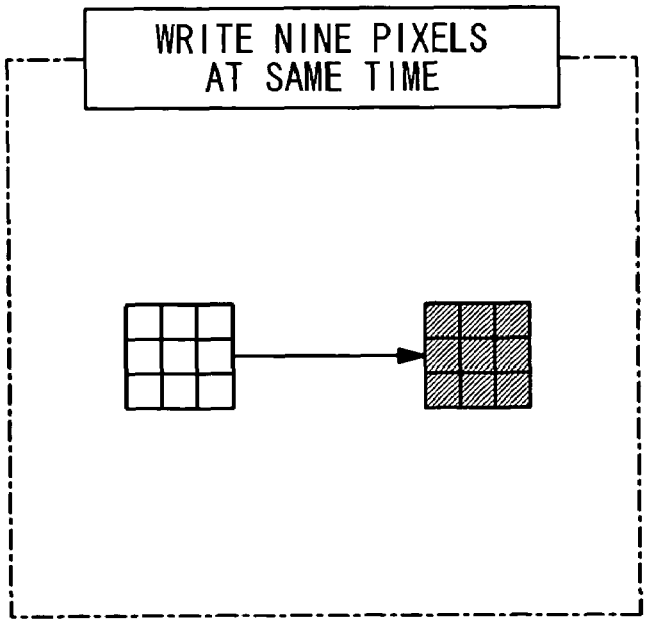
FIG. 12B is a diagram showing a write operation in a font process memory in the mobile terminal of the fifth embodiment.

FIG. 12A and FIG. 12B show examples in which the color reference numbers of pixels are written. The pixels are arranged within the rectangular area in a plurality of rows and a plurality of columns. As shown in FIG. 12A, the writing operation of the pixel data is carried out for every pixel in the most typical conventional frame memory. The writing operation of the pixel data is sequentially carried out nine times in a matrix of 3 rows×3 columns. On the other hand, in the fifth embodiment, the pixel data are simultaneously written in memory cells of the font process memory 23*c*' in the matrix of 3 rows×3 columns. This allows the write operation of the color reference number data 25' into the font process memory 23*c* in a high speed.

Figure 13:
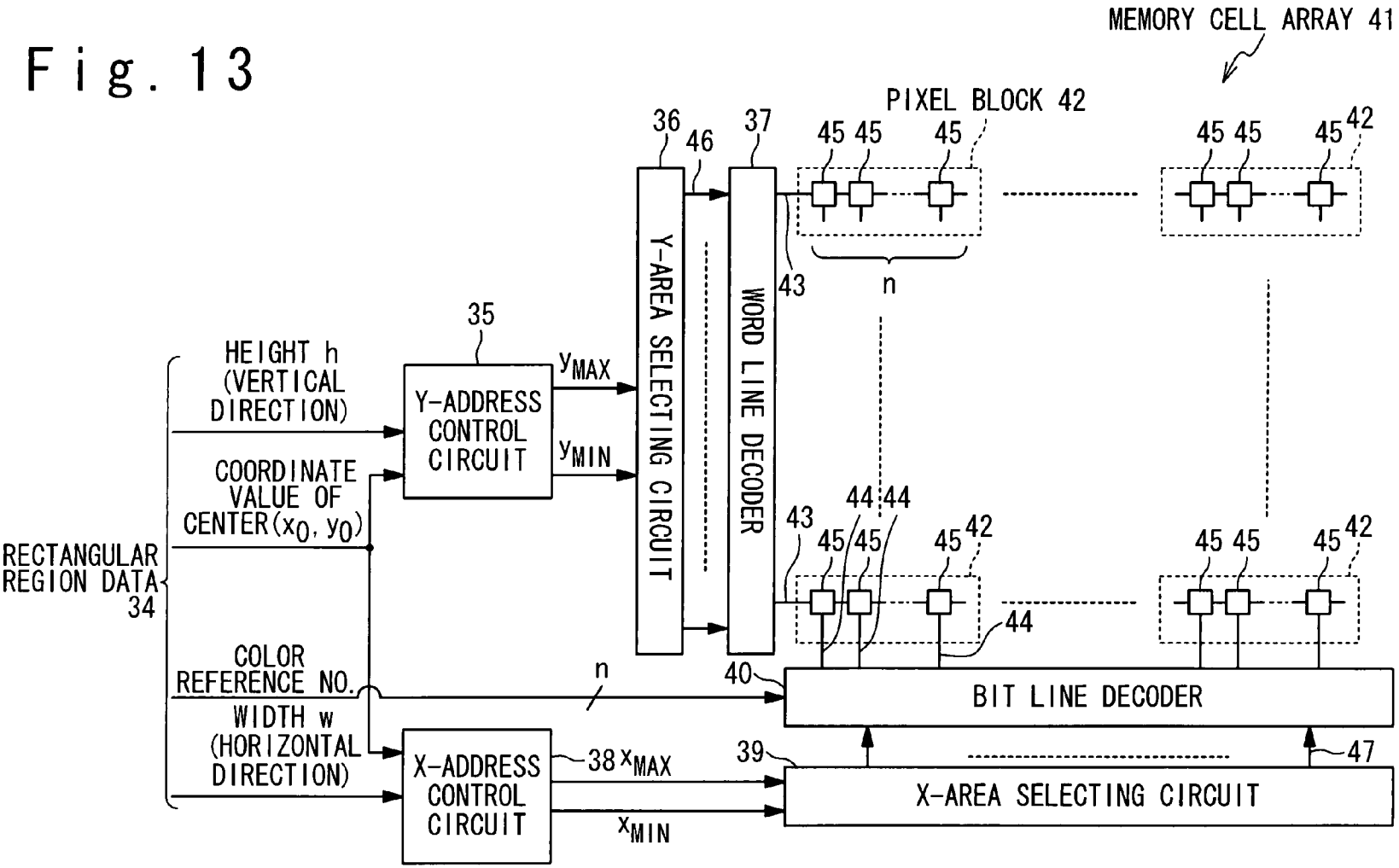
FIG. 13 is a block diagram showing the hardware configuration of the font process memory.

FIG. 13 is a block diagram showing the hardware configuration of the font process memory 23*c*'. The font process memory 23*c*' is composed of a Y-address control circuit 35, a Y-area selecting circuit 36, a word line decoder 37, an X-address control circuit 38, an X-area selecting circuit 39, a bit line decoder 40, and a memory cell array 41. The memory cell array 41 is provided with pixel blocks 42 arranged in a matrix form, word lines 43, and bit lines 44. The pixel block 42 is addressed based on an x-address and a y-address. The pixel block 42 is provided with n memory cells 45 in the horizontal direction. Pixel data (namely, color reference number) for one pixel is stored into one pixel block 42. It should be understood that the pixel data is composed of an n-bit color reference number. The memory cells 45 are positioned at locations where the word lines 43 are intersected to the bit lines 44.

The Y-address control circuit 35 calculates a maximum value "$y_{MAX}$" of the y-address and a minimum value "$y_{MIN}$" of the y-address for the rectangular area indicated in the rectangular area data 34 based upon the y coordinate "$y_0$" of the rectangular area and the height "h" of the rectangular area. The calculation method of the maximum value $y_{MAX}$ and the minimum value $y_{MIN}$ are different, depending upon whether the height "h" is an odd number or an even number. When the height "h" is the odd number, the maximum and minimum values $y_{MAX}/y_{MIN}$ are calculated from the following equations:

$$y_{MAX}=y_0+h/2, \text{ and}$$

$$y_{MIN}=y_0-h/2.$$

When the height "h" is the even number, the maximum and minimum values $y_{MAX}/y_{MIN}$ are calculated from the following equations:

$$y_{MAX}=y_0+h/2, \text{ and}$$

$$y_{MIN}=y_0-h/2-1.$$

The Y-area selecting circuit 36 outputs y-address signals 46 to the word line decoder 37 based on the maximum value $y_{MAX}$ and the minimum value $y_{MIN}$ of the y-address of the rectangular area. Each y-address signal 46 indicates whether or not a corresponding y-address is selected. When the number of the pixel blocks 42 arranged in a column direction is "M", namely, when the y-address has a value equal to or larger than "0", and equal to or smaller than "M−1", "M" y-address signals 46 are outputted to the word line decoder 37. The Y-area selecting circuit 36 activates the y-address signals 46 to be selected, i.e., the y-addresses $y_{MIN}$ to $y_{MAX}$. It should also be understood that the plurality of y-addresses can be selected in the writing operation.

The word line decoder 37 activates the word line 44 in response to the y-address signals 46. When the plurality of y-addresses are selected, the plurality of word lines are made active at a same time. When the word line 43 is activated, the memory cells 45 connected to the activated word lines 43 are connected to the bit lines 44.

Similar to the Y-address control circuit 35, the X-address control circuit 38 calculates a maximum value "$x_{MAX}$" of an x-address and a minimum value "$x_{MIN}$" of the x-address in the rectangular area indicted in the rectangular area data 34 based on the x coordinate "$x_0$" and width "W" of the rectangular area. The calculation method of the maximum value $x_{MAX}$ and the minimum value $x_{MIN}$ are different depending upon whether the width "W" is an odd number or an even number.

When the width "W" corresponds to the odd number, the maximum and minimum values $x_{MAX}/x_{MIN}$ are calculated from the following equations:

$$x_{MAX}=x_0+w/2, \text{ and}$$

$$x_{MIN}=x_0-w/2.$$

When the width W is the even number, the maximum and minimum values $x_{MAX}/x_{MIN}$ are calculated from the following equations:

$$x_{MAX}=x_0+w/2, \text{ and}$$

$$x_{MIN}=x_0+W/2-1$$

The X-area selecting circuit 39 outputs x-address signals 47 to the bit line decoder 40 in response to the maximum value $x_{MAX}$ and the minimum value $x_{MIN}$ of the x-addresses of the rectangular area. Each x-address signal 47 indicate whether or not a corresponding x-address is selected. When the number of the pixel blocks 42 arranged in the row direction is "N", namely, when x-address is equal to or larger than "0", and equal to or smaller than "N-1", "N" x-address signals 47 are outputted to the bit line decoder 40. The X-area selecting circuit 39 activates the x address signals 47 to be selected, i.e., x address signals xMIN to xMAX. It should be understood that the plurality of x addresses can be selected in the writing operation. Thus, the pixel blocks 42 are selected based on both of the y-addresses selected by the Y-area selecting circuit 36 and the x-addresses selected by the X-area selecting circuit 39.

The bit line decoder 40 connects the bit lines 44 corresponding to the selected x-addresses to "n" signal lines based on the x-address signals 47 such that the color reference numbers are transferred to the font process memory 23*c*'. As a result, the color reference signals are written into the selected pixel blocks 42. In other words, the data bits corresponding to the color reference numbers are written in the memory cells 45 of the selected pixel block 42. In this way, a plurality of rows and columns of the pixel blocks can be selected in the font process memory 23*c*' and the color reference numbers can be written in the selected pixel blocks 42 at a same time.

Figure 14:
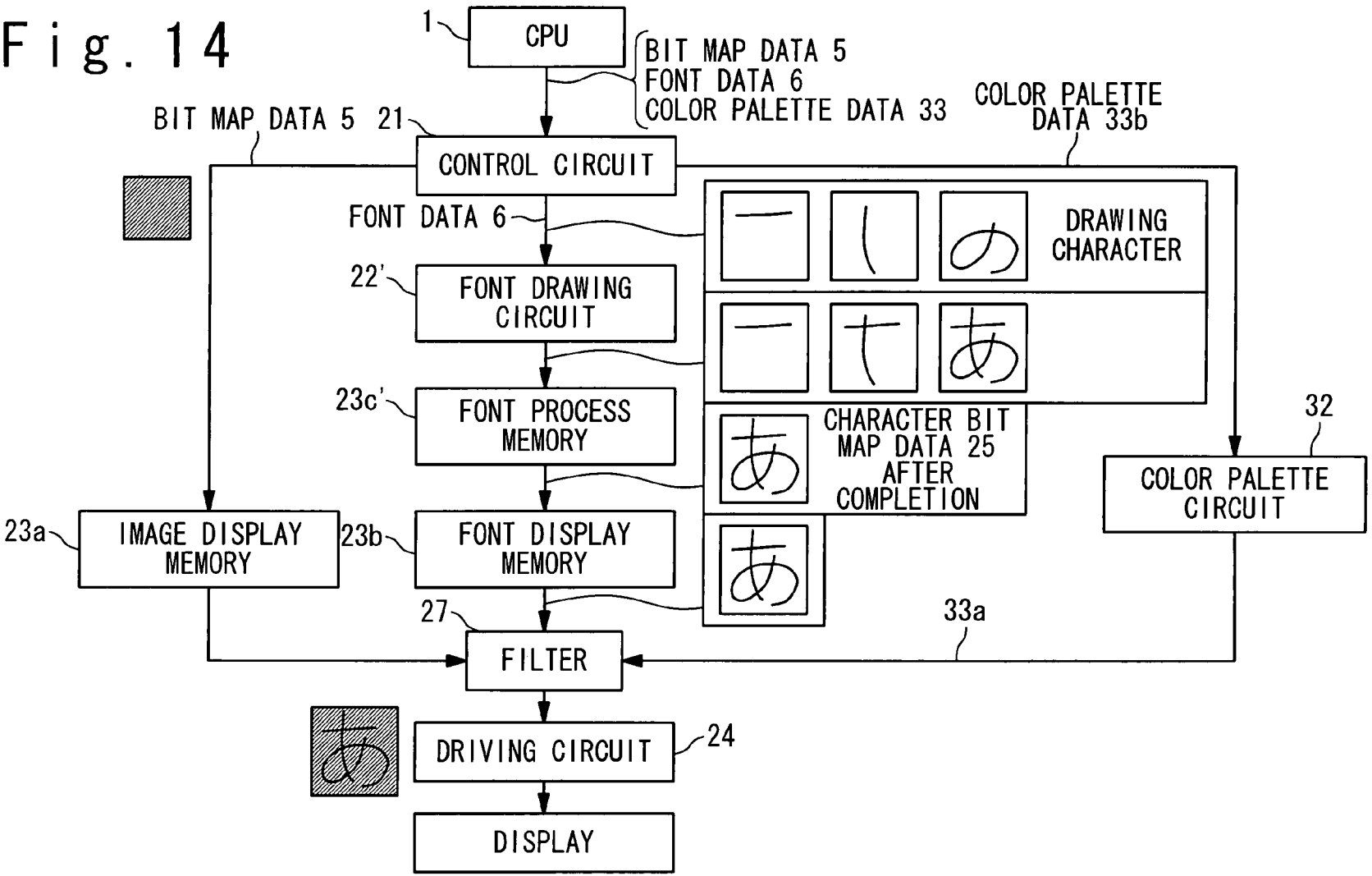
FIG. 14 is a block diagram showing an operation of the controller driver according to the fifth embodiment when the on-screen display is carried out.

FIG. 14 is a block diagram showing an operation of the controller driver 2 according to the fifth embodiment when the on-screen display is carried out. When the background bit map data 5 of the background image and the font data 6 of the character image to be superimposed on the background image are sent from the CPU 1 to the control circuit 21, the control circuit 21 sends the background bit map data 5 to the image display memory 23*a* and the font data 6 to the font drawing circuit 22'. The background bit map data 5 is written in the image display memory 23*a*. When the color palette data 33*b* is sent from the CPU 1, the control circuit 21 writes the color palette data 33*b* into the color palette circuit 32. The font drawing circuit 22' sequentially interprets commands contained in the font data 6, and grasps the shape of the character image to be displayed, and separates the character image into rectangular areas. Further, the font drawing circuit 22' sequentially sends the rectangular area data 34 to the font process memory 23*c*' for "drawing of character". It should be noted that color reference numbers of a plurality of pixels contained in a certain rectangular area are written in the font process memory 23*c*' at a same time. As a result of the completion of "drawing of character", the color reference number data 25' are completed in the font process memory 23*c*'. After the color reference number data 25' are completed in the font process memory 23'*c*, the color reference number data 25' are transferred to the font display memory 23*b*. The transfer operation of the color reference number data 25' to the font display memory 23*b* is carried out within a short time, as compared with the refresh cycle of the LCD panel 3. The filter 27 reads the background bit map data 5 from the image display memory 23*a* and the color reference number data 25' from the font display memory 23*b*. Then, the filter 27 produces the synthetic bit map data 29. The filter 27 converts the color reference numbers of the color reference number data 25' into character RGB data, and calculates the character RGB data with the RGB data of the background bit map data 5 to produce the synthetic bit map data 29. The driving circuit 24 drives the LCD panel 3 based on the synthetic bit map data 29 sent from the filter 27, so that the on-screen display of the character image can be achieved.

Similar to the first embodiment, according to the fifth embodiment, the data quantity of the display data sent from the CPU 1 to the controller driver 2 is made small to reduce both the power consumption of the controller driver 2 and EMI.

Also, according to the fifth embodiment, since the pixel data of the character image stored in the font display memory 23*b* and the font process memory 23*c*' are described by using the color reference numbers, the memory capacities of the font display memory 23*b* and the font process memory 23*c*' can be decreased.

In addition, in the fifth embodiment, the pixel data for a plurality of rows and columns of the pixels both the plural rows and the plural columns can be written into these font drawing circuit 22 and font process memory 23*c*' at a same time. As a result, the data process operation for displaying the character image can be carried out in a high speed.

In the fifth embodiment, only one of the above-mentioned two features may be to the controller driver 2. In other words, the pixel data of the character image stored in the font display memory 23*b* and the font process memory 23*c*' is not described by using the color reference numbers, but by using the normal format of RGB data. In this case, not such color reference numbers but RGB data are described in the rectangular area data 34. Namely, not the above-mentioned color reference number data 25', but the character bit map data 25 are stored in the font display memory 23*b* and the font process memory 23*c*'. Even when such hardware configuration is employed, the pixel data of the plurality of rows and columns of the pixels may be written into the font drawing circuit 22 and font process memory 23*c*' at the same time for the data process operation in a high speed. Alternatively, the pixel data of the plurality of rows and columns of the pixels may be not written into these font drawing circuit 22 and font process memory 23*c*' at the same time. Even in such an case, the storage capacities of the font display memory 23*b* and the font process memory 23*c*' can be decreased by describing the pixel data of the character image stored in both the font display memory 23*b* and the font process memory 23*c*' in the format of the color reference numbers.

What is claimed is:

1. A controller driver comprising:

a driving processing circuit configured to receive background bit map data of a background image and font data for a character image, wherein said font data for a pixel is described in a format in which a bit length of said font data for the pixel shorter than in a RGB format; and a font drawing circuit configured to generate pixel data of said character image from said font data, wherein said driving processing circuit displays on a display panel a synthetic image in which said character image is superimposed on said background image in an on-screen display mode, by driving said display panel based on said background bit map data and said pixel data of said character image.

2. The controller driver according to claim 1, wherein said font data has a stroke font format.

3. The controller driver according to claim 1, wherein said driving processing circuit comprises a control circuit sets one of said on-screen display mode, an on-screen display mode with a change of said synthetic image, and a normal display mode based on a received control signal.

4. The controller driver according to claim 3, wherein said driving processing circuit comprises:

an image display memory configured to store display bit map data of said synthetic image; and a driving circuit configured to drive said display panel based on said display bit map data, and character bit map data as said pixel data of said character image from said font drawing circuit is written in said image display memory in which said background bit map data has been written, to generate said display bit map data.

5. The controller driver according to claim 3, wherein said driving processing circuit comprises:

a font display memory configured to store character bit map data as said pixel data of said character image;

an image display memory configured to store said background bit map data;

a filter circuit configured to read out said character bit map data of said character image from said font display memory, to read out said background bit map data from said image display memory, and to generate display bit map data of said synthetic image from said read character bit map data and said background bit map data, in said on-screen display mode; and a driving circuit configured to drive said display panel based on said bit map data of said synthetic image.

6. The controller driver according to claim 5, wherein said filter circuit reads out said background bit map data from said image display memory as said display bit map data in said normal display mode different.

7. The controller driver according to claim 3, wherein said driving processing circuit comprises:

a font display memory configured to store character bit map data as said pixel data of said character image;

an image display memory configured to store said background bit map data; a font process memory configured to write said character bit map data from said font drawing circuit in said font display memory when said character bit map data is completed;

a filter circuit configured to read out said character bit map data of said character image from said font display memory, to read out said background bit map data from said image display memory, and to generate display bit map data of said synthetic image from said read character bit map data and said background bit map data, in said on-screen display mode; and a driving circuit configured to drive said display panel based on said display bit map data of said synthetic image.

8. The controller driver according to claim 7, wherein said filter circuit reads out said background bit map data from said image display memory as said display bit map data in said normal display mode.

9. The controller driver according to claim 3, wherein said driving processing circuit comprises:

a font display memory configured to store character bit map data as said pixel data of said character image;

an image display memory configured to store said background bit map data;

a font process memory configured to write said character bit map data from said font drawing circuit in said font display memory when said character bit map data is completed;

a calculating circuit configured to read out said character bit map data from said font display memory in said on-screen display mode;

a filter circuit configured to read out said background bit map data from said image display memory, to receive said character bit map data from said calculating circuit, and to generate display bit map data of said synthetic image from said received character bit map data and said background bit map data, in said on-screen display mode; and a driving circuit configured to drive said display panel based on said display bit map data of said synthetic image.

10. The controller driver according to claim 9, wherein said filter circuit transfers said background bit map data to said calculating circuit, in said on-screen display mode with the change of said synthetic image, and said calculating circuit generates calculation bit map data as display bit map data of said synthetic image from said character bit map data stored in said font display memory and said background bit map data, to supply to said driving circuit, in said on-screen display mode with the change of said synthetic image.

11. The controller driver according to claim 9, wherein said filter circuit transfers said background bit map data as display bit map data of said synthetic image to said driving circuit in said normal display mode.

12. The controller driver according to claim 3, wherein said font drawing circuit outputs rectangular area data with a color reference number for each of structural elements of said character image from said font data, said driving processing circuit comprises:

a font display memory configured to store said color reference numbers for said character image;

an image display memory configured to store said background bit map data;

a font process memory configured to write said color reference numbers of said rectangular area data from said font drawing circuit in said font display memory when said color reference numbers is completed;

a color palette circuit configure to store color palette data indicating a relation of said color reference number and a color;

a filter circuit configured to generate character bit map data from said color reference numbers by referring to said color palette circuit, to read out said background bit map data from said image display memory, and to generate display bit map data from said background bit map and said character bit map data; and a driving circuit configured to drive said display panel based on said display bit map data of said synthetic image.

13. The controller driver according to claim 12, wherein said filter circuit reads out said background bit map data from said image display memory as said display bit map data in said normal display mode.

14. The controller driver according to claim 12, wherein said font drawing circuit divides said character image into rectangular areas, and generates said rectangular area data to designate a color of said pixels of said character image contained in each of said rectangular areas.

15. controller driver according to claim 1, wherein the frequency of a clock signal to be supplied to said font drawing circuit is lower than that of a clock signal to be supplied to a device which sends said background bit map data and said font data to said driving process circuit.

16. The controller driver according to claim 1, wherein said driving processing circuit comprises:

a calculating circuit configured to read out said character bit map data from said font display memory in said on-screen display mode; and a filter circuit configured to read out said background bit map data from said image display memory, to receive said character bit map data from said calculating circuit, and to generate display bit map data of said synthetic image from said received character bit map data and said background bit map data, in said on-screen display mode;

wherein said filter circuit transfers said background bit map data to said calculating circuit, in said on-screen display mode with the change of said synthetic image.

17. The controller driver according to claim 1, wherein said driving processing circuit comprises:

a font process memory configured to write said character bit map data from said font drawing circuit in said font display memory when said character bit map data is completed;

a calculating circuit configured to read out said character bit map data from said font display memory in said on-screen display mode; and a driving circuit configured to drive said display panel based on said display bit map data of said synthetic image, wherein said calculating circuit generates calculation bit map data as display bit map data of said synthetic image from said character bit map data stored in said font display memory and said background bit map data, to supply to said driving circuit, in said on-screen display mode with the change of said synthetic image.

18. A mobile terminal comprising:

a display panel;

a CPU configured to supply background bit map data of a background image and font data for a character image, wherein said font data has a stroke font format; and a controller driver, wherein said controller driver comprises:

a font drawing circuit configured to generate pixel data of said character image from said font data; and a driving processing circuit configured to display on a display panel a synthetic image in which said character image is superimposed on said background image in an on-screen display mode, by driving said display panel based on said background bit map data and said pixel data of said character image.

19. The mobile terminal according to claim 18, wherein said driving processing circuit comprises a control circuit sets one of said on-screen display mode, an on-screen display mode with a change of said synthetic image, and a normal display mode based on a received control signal.

20. The mobile terminal according to claim 19, wherein said driving processing circuit comprises:

an image display memory configured to store display bit map data of said synthetic image; and a driving circuit configured to drive said display panel based on said display bit map data, and character bit map data as said pixel data of said character image from said font drawing circuit is written in said image display memory in which said background bit map data has been written, to generate said display bit map data.

21. The mobile terminal according to claim 19, wherein said driving processing circuit comprises:

a font display memory configured to store character bit map data as said pixel data of said character image;

an image display memory configured to store said background bit map data;

a filter circuit configured to read out said character bit map data of said character image from said font display memory, to read out said background bit map data from said image display memory, and to generate display bit map data of said synthetic image from said read character bit map data and said background bit map data, in said on-screen display mode; and a driving circuit configured to drive said display panel based on said bit map data of said synthetic image.

22. The mobile terminal according to claim 21, wherein said filter circuit reads out said background bit map data from said image display memory as said display bit map data in said normal display mode different.

23. The mobile terminal according to claim 19, wherein said driving processing circuit comprises:

a font display memory configured to store character bit map data as said pixel data of said character image;

an image display memory configured to store said background bit map data;

a font process memory configured to write said character bit map data from said font drawing circuit in said font display memory when said character bit map data is completed;

a filter circuit configured to read out said character bit map data of said character image from said font display memory, to read out said background bit map data from said image display memory, and to generate display bit map data of said synthetic image from said read character bit map data and said background bit map data, in said on-screen display mode; and a driving circuit configured to drive said display panel based on said display bit map data of said synthetic image.

24. The mobile terminal according to claim 23, wherein said filter circuit reads out said background bit map data from said image display memory as said display bit map data in said normal display mode.

25. The mobile terminal according to claim 19, wherein said driving processing circuit comprises:

a font display memory configured to store character bit map data as said pixel data of said character image;

an image display memory configured to store said background bit map data;

a font process memory configured to write said character bit map data from said font drawing circuit in said font display memory when said character bit map data is completed;

a calculating circuit configured to read out said character bit map data from said font display memory in said on-screen display mode;

a filter circuit configured to read out said background bit map data from said image display memory, to receive said character bit map data from said calculating circuit, and to generate display bit map data of said synthetic image from said received character bit map data and said background bit map data, in said on-screen display mode; and a driving circuit configured to drive said display panel based on said display bit map data of said synthetic image.

26. The mobile terminal according to claim 25, wherein said filter circuit transfers said background bit map data to said calculating circuit, in said on-screen display mode with the change of said synthetic image, and said calculating circuit generates calculation bit map data as display bit map data of said synthetic image from said character bit map data stored in said font display memory and said background bit map data, to supply to said driving circuit, in said on-screen display mode with the change of said synthetic image.

27. The mobile terminal according to claim 25, wherein said filter circuit transfers said background bit map data as display bit map data of said synthetic image to said driving circuit in said normal display mode.

28. The mobile terminal according to claim 19, wherein said font drawing circuit outputs rectangular area data with a color reference number for each of structural elements of said character image from said font data, said driving processing circuit comprises:

a font display memory configured to store said color reference numbers for said character image;

an image display memory configured to store said background bit map data;

a font process memory configured to write said color reference numbers of said rectangular area data from said font drawing circuit in said font display memory when said color reference numbers is completed;

a color palette circuit configure to store color palette data indicating a relation of said color reference number and a color;

a filter circuit configured to generate character bit map data from said color reference numbers by referring to said color palette circuit, to read out said background bit map data from said image display memory, and to generate display bit map data from said background bit map and said character bit map data; and a driving circuit configured to drive said display panel based on said display bit map data of said synthetic image.

29. The mobile terminal according to claim 28, wherein said filter circuit reads out said background bit map data from said image display memory as said display bit map data in said normal display mode.

30. The mobile terminal according to claim 28, wherein said font drawing circuit divides said character image into rectangular areas, and generates said rectangular area data to designate a color of said pixels of said character image contained in each of said rectangular areas.

31. The mobile terminal according to claim 18, wherein the frequency of a clock signal to be supplied to said font drawing circuit is lower than that of a clock signal to be supplied to said CPU.

32. The mobile terminal according to claim 18, wherein said driving processing circuit comprises:

a calculating circuit configured to read out said character bit map data from said font display memory in said on-screen display mode; and a filter circuit configured to read out said background bit map data from said image display memory, to receive said character bit map data from said calculating circuit, and to generate display bit map data of said synthetic image from said received character bit map data and said background bit map data, in said on-screen display mode;

wherein said filter circuit transfers said background bit map data to said calculating circuit, in said on-screen display mode with the change of said synthetic image.

33. The mobile terminal according to claim 18, wherein said driving processing circuit comprises:

a font process memory configured to write said character bit map data from said font drawing circuit in said font display memory when said character bit map data is completed;

a calculating circuit configured to read out said character bit map data from said font display memory in said on-screen display mode; and a driving circuit configured to drive said display panel based on said display bit map data of said synthetic image, wherein said calculating circuit generates calculation bit map data as display bit map data of said synthetic image from said character bit map data stored in said font display memory and said background bit map data, to supply to said driving circuit, in said on-screen display mode with the change of said synthetic image.

* * * * *